US009567704B2

(12) United States Patent
Ros et al.

(10) Patent No.: US 9,567,704 B2
(45) Date of Patent: Feb. 14, 2017

(54) TUMBLE DRYER

(71) Applicant: Electrolux Appliances Aktiebolag, Stockholm (SE)

(72) Inventors: Paolo Ros, Porcia (IT); Diego Dal Ben, Zoppola (IT); Marco Santarossa, S. Quirino (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 0 days.

(21) Appl. No.: 14/781,846

(22) PCT Filed: Mar. 31, 2014

(86) PCT No.: PCT/EP2014/056442
§ 371 (c)(1),
(2) Date: Oct. 1, 2015

(87) PCT Pub. No.: WO2014/161813
PCT Pub. Date: Oct. 9, 2014

(65) Prior Publication Data

US 2016/0053428 A1 Feb. 25, 2016

(30) Foreign Application Priority Data

Apr. 3, 2013 (EP) ..... 13162069

(51) Int. Cl.
*D06F 58/12* (2006.01)
*D06F 58/28* (2006.01)
*D06F 58/22* (2006.01)

(52) U.S. Cl.
CPC ..... *D06F 58/28* (2013.01); *D06F 58/22* (2013.01); *D06F 2058/2858* (2013.01)

(58) Field of Classification Search
CPC ..... F26B 19/00; F26B 21/00; D06F 58/00; D06F 58/12; D06F 58/20
(Continued)

(56) References Cited

U.S. PATENT DOCUMENTS 2,779,305 A * 1/1957 Dunkelman ..... D06F 58/22 116/112
3,122,426 A * 2/1964 Horecky ..... D06F 58/28 34/531
(Continued)

FOREIGN PATENT DOCUMENTS

BE EP 2584086 A1 * 4/2013 ..... D06F 58/22
CN 201276656 Y 7/2009
(Continued)

OTHER PUBLICATIONS

International Search Report mailed Jul. 29, 2014 in related International Application No. PT/EP2014/056442.

*Primary Examiner* — Stephen M Gravini
(74) *Attorney, Agent, or Firm* — Banner & Witcoff, Ltd.

(57) ABSTRACT

A tumble dryer (100) is provided having: a laundry drum (102) rotatably supported in a casing (110) and suitable to receive laundry to be dried. A lint filter assembly (1) can be housed in a housing (105) provided in the casing (110) so that, when the lint filter assembly (1) is placed in the housing (105), it intercepts a flow of air exiting the laundry drum (102). A humidity sensor system retrieves information about the actual humidity of the laundry in the drum (102) and has at least a pair of electrodes (20) positioned such that the laundry in the drum (102) can come into contact with the electrodes (20). A control unit (150) controls the operations of the tumble dryer; and an electric circuit (21, 22, 23) transmits a signal obtained from the electrodes (20) to the control unit (150). The electric circuit (21, 22, 23) has at least one electrical connector (22, 23) arranged in such a way to electrically connect the electrodes (20) to the control unit (150) when the filter assembly (1) is correctly positioned in the housing (105) and not to connect the electrodes (20) to the control unit (150) when the filter assembly (1) is
(Continued)

not positioned or not correctly positioned in the housing (105).

18 Claims, 7 Drawing Sheets

(58) Field of Classification Search
USPC ..... 34/601, 610; 68/19, 20; 8/149
See application file for complete search history.

(56) References Cited

U.S. PATENT DOCUMENTS 4,477,982 A * 10/1984 Cotton ..... D06F 58/28 34/550
4,546,554 A * 10/1985 Bullock ..... D06F 58/02 34/554
4,899,464 A * 2/1990 Carr ..... D06F 58/04 34/604
5,097,606 A 3/1992 Harmelink et al.
5,625,962 A * 5/1997 Fleissner ..... F26B 13/16 34/446
5,709,040 A * 1/1998 Horwitz ..... D06F 58/22 34/565
5,940,986 A * 8/1999 Jelinek ..... D06F 58/04 34/528
6,941,678 B2 * 9/2005 Park ..... D06F 58/28 34/528
6,941,680 B1 * 9/2005 Zielewicz ..... D06F 58/20 34/607
6,971,186 B1 * 12/2005 Chin ..... D06F 58/22 34/140
7,040,039 B1 * 5/2006 Stein ..... D06F 58/22 34/529
7,506,458 B2 * 3/2009 Lee ..... D06F 58/04 34/601
7,975,400 B2 * 7/2011 Dittmer ..... D06F 58/28 204/560
8,256,137 B2 * 9/2012 Noviello ..... D06F 58/20 34/413
8,387,272 B2 * 3/2013 Kim ..... D06F 58/28 165/166
8,468,711 B2 * 6/2013 Kim ..... D06F 58/22 134/12
8,869,421 B2 * 10/2014 Kim ..... D06F 5/00 34/381
8,997,377 B2 * 4/2015 Kim ..... D06F 58/22 34/610
9,045,854 B2 * 6/2015 Clark ..... D06F 58/02
9,163,352 B2 * 10/2015 Han ..... D06F 58/26
9,249,539 B2 * 2/2016 Hubig ..... A47L 15/0034
9,250,016 B2 * 2/2016 Kim ..... F26B 21/003
2009/0126220 A1 * 5/2009 Nawrot ..... D06F 58/28 34/497
2011/0016736 A1 1/2011 Kim et al.
2016/0053428 A1 * 2/2016 Ros ..... D06F 58/22 34/82
2016/0222576 A1 * 8/2016 Yoo ..... D06F 58/28

FOREIGN PATENT DOCUMENTS

EP 0250789 A1 1/1988
EP 0443361 A1 8/1991
EP 1473402 A1 11/2004
EP 2365122 A1 9/2011
EP 2392723 A2 12/2011
EP 2458075 A1 5/2012
GB 2318408 A 4/1998
IT EP 0106289 A2 * 4/1984 ..... D06F 58/22
JP 06190196 A * 7/1994
SE EP 2787116 A1 * 10/2014 ..... D06F 58/22

* cited by examiner 14
10A
21
16
21
16
11A
18
10B
11B
3
15
15
13
20a
20a
21
16
22'
21
2
22'
21
13
20a
20a
21
13
22
22
6
16
21

TUMBLE DRYER

FIELD OF THE INVENTION

The present invention relates to a tumble dryer with a humidity sensor and a lint filter assembly.

BACKGROUND

Tumble dryers generally comprise an external casing provided with a rotatable drum where the wetted clothes to be dried are placed.

The drying effect is obtained by a flow of heated air forced inside the drum so as to pass through the tumbling clothes. The heated air removes the moisture from the clothes and then the air with moisture, i.e. the exhausted air, is expelled from the drum.

In conventional clothes dryers the duration of the drying cycle is based on the detected moisture level of the clothes. To this purpose, dryers include a moisture (or humidity) sensor in order to obtain information about the actual humidity of the laundry during the drying cycle.

A moisture sensor belonging to the know technique is disclosed in document U.S. Pat. No. 5,940,986; this document discloses a sensor placed inside the drum which comes into contact with the tumbling clothes during the drum rotation.

The sensor comprises a pair of elongated electrodes facing the interior of the drum such that during the drying cycle the clothes periodically engage and bridge the electrodes one another. The sensor electrodes are connected to a dryer moisture sensing circuit. The electrical resistance (or inductance) measured between the electrodes is indicative of the moisture level of the clothes bridging the electrodes. A high electrical resistance between the electrodes is indicative that the clothes are dry. A low electrical resistance between the electrodes is indicative of wet clothes bridging the electrodes.

In order to properly face the interior of the drum and to promote the contact with clothes, the electrodes are positioned next to the exhausted air opening. For example, in U.S. Pat. No. 5,940,986 the electrodes are mounted on an exhaust vent cover, partially covering the exhaust air opening and secured to the bulkhead of the dryer by a pair of fasteners.

As such, the front bulkhead assembly cooperates with the exhaust vent cover and the exhaust duct to define a receptacle for a blade-type lint filter, preventing the passage of fluff towards the exhaust duct. The lint filter is inserted vertically downwardly into the receptacle, and has an enlarged flange or rim that rests upon the surfaces surrounding the exhaust air opening. Similar solutions are disclosed in EP 1 473 402 or in EP 2 458 075,wherein the electrodes are positioned on a support fastened next to the exhaust air opening into which a pocket-type lint filter can be inserted.

In order to have a proper maintenance of this kind of dryers, the lint filter should be periodically removed and cleaned and, occasionally, also the electrodes should be at least wiped.

Nevertheless, it can be problematic to make the lint filter quickly removable and, at the same time, having electrodes easily reachable by the hand of a person. In fact, the front bulkheads should be preferably compact and the space available for the lint filter and for the electrodes and the respective support is quite limited.

As a consequence, it could be relatively troublesome to place back the lint filter properly in the receptacle after it has been removed for cleaning purpose. If the lint filter is improperly positioned, exhausted air might flow directly in the outlet conduit, with a risk of deposition of fluff in areas and/or components which may worse the functionality of the dryer or even cause serious safety risks.

To this regard, EP 0 443 361,GB2318408 or EP 0 250 789 disclose dryers comprising devices capable of controlling a proper positioning of the lint filter.

Nevertheless, these solutions require a dedicated circuit in order to provide information about the position of the filter and, in general, a more complex design of the dryer.

SUMMARY OF SELECTED INVENTIVE ASPECTS

An object of the invention is to provide a tumble dryer that overcomes the drawbacks of known dryers.

A further object is to provide a tumble dryer having a simplified geometry of the exhausted air outlet.

Furthermore, it is also an object of the present invention to provide a tumble dryer with a lint filter in which the user can be alerted and/or operation of the machine can be prevented in case the lint filter is improperly positioned or not positioned at all.

A still further object is to provide a tumble dryer with a simplified electric circuit.

According to at least one aspect of the invention, a tumble dryer comprising:

- a laundry drum rotatably supported in a casing and suitable to receive laundry to be dried;
- a lint filter assembly which can be placed in a housing provided in the casing so that, when the lint filter assembly is placed in said housing, it intercepts a flow of air exiting the laundry drum;
- a humidity sensor system for retrieving information about the actual humidity of the laundry in the drum, the humidity sensor system comprising at least a pair of electrodes positioned such that the laundry in the drum can come into contact with the electrodes;
- a control unit for controlling the operations of the tumble drier;
- an electric circuit for transmitting a signal obtained from the electrodes to the control unit;

the electric circuit comprises at least one electrical connector arranged in such a way to electrically connect the electrodes to the control unit when the filter assembly is correctly positioned in the housing and not to connect the electrodes to the control unit when the filter assembly is not positioned or not correctly positioned in the housing.

It has to be understood that expression "correctly positioned" means positioned in such a way to correctly fit the housing, or, in other words, it means positioned in such a way that substantially all the air exiting the drum is intercepted by the filter; the expression "incorrectly positioned" means that the filter hasn't been inserted into its housing in such a way to correctly fit the housing (for example it could have been inserted upside-down, or it could have been only partially introduced into the housing), in which case a part of the air flux exiting the drum can enter the housing of the filter without being intercepted by the latter.

It is to be understood that in the tumble dryer according to aspects of the invention, the electric circuit of the humidity sensor system can be advantageously used for the obtaining information about both the actual humidity of the laundry and the position/presence of the filter.

The electrical connector—which electrically connects the electrodes to the control only if the filter is correctly positioned in its housing—can be advantageously used in order to inhibit the operation of the dryer in case the filter is removed or it is improperly (or not correctly) positioned in its housing.

This makes it possible to simplify the manufacturing of the electric circuit provided for transmitting a signal obtained from the electrodes to the control unit of the tumble drier, since at least a part of this circuit is provided on the filter assembly.

According to a preferred embodiment, in the tumble dryer according to the present invention the housing is defined on a peripheral surface of the mouth through which the laundry can be loaded/unloaded in/from. The mouth and the respective peripheral surface are formed on the front bulkhead of the dryer, so that the filter assembly can be easily reachable.

Preferably, the lint filter assembly comprises a frame supporting at least one filtering surface and the electrodes are positioned on a supporting surface of the frame facing the internal of the laundry drum when the filter assembly is placed in its housing.

In this manner, it is possible to eliminate any dedicated support for the electrodes since they are positioned on the filter, i.e. on a component that is already used in the machine and, in general, to simplify the geometry of the air duct. Furthermore, this also allows an easy and simple maintenance and cleaning of the electrodes, since they can be removed together with the filter, which simplifies their cleaning.

According to a further preferred aspect, the supporting surface supporting the electrodes is placed above a mouth of the housing and, always preferably, said supporting surface comprises perforations allowing the passage of the flow of exhausted air towards the filtering surface of the filter. These features advantageously permits to provide a tumble dryer with a larger outlet for the flow of exhausted air compared to prior art machines, as no other support or elements for mounting the electrodes are required to be placed next to the filter assembly housing.

Preferably, the filter assembly also comprises a further perforated surface tilted to the supporting surface of the electrodes, thus proving a wider surface for the passage of exhausted air with a compact and simple solution.

According to another preferred embodiment, the supporting surface develops as curved surface, slanting from the mouth of the front bulkhead towards the drum in order to obtain a smooth transition from the mouth to the laundry drum.

According to a further preferred aspect, the electrical connector comprises at least a plug and socket connection. The plug and socket are preferably provided on the lint filter assembly and on the front bulkhead, respectively, or vice-versa. This advantageously allows having a reliable contact, suitable for being opened and closed repeatedly.

According to a preferred embodiment, the filter assembly comprises a border which is at least partially resting on an edge of the housing so as to promote a precise positioning of the filter without requiring any fastening means.

Preferably, the plug projects from the border, such that the contact between the plug and the socket is closed when the border rests on the edge of the seat.

According to another preferred aspect of the invention, the electrodes are removably housed in a respective seat on the supporting surface thus allowing an easy assembling and replacement of the electrodes.

According to other preferred aspects, the tumble dryer comprises a first and a second electric contact each connected to a respective electrode. Preferably, the lint filter assembly is wedge-shaped and has a substantially rectangular cross section, with the electrical connectors positioned at the same short side of the rectangle. These features make it possible to verify the correct positioning of the filter assembly in a precise and reliable manner by means of the electrical connector, since they electrically connect the electrodes to the control unit only if the filter is correctly positioned in its housing.

Still according to a further aspect of the invention, the control unit is configured in such a way to emit a warning signal and/or to inhibit operation of the dryer when the electrodes are not electrically connected to the control unit. This aspect advantageously contributes to avoid any risk of operating the dryer with the lint filter is removed or incorrectly positioned.

Advantageously, the tumble drier comprises a first and a second electrical connector each connected to a respective electrode.

BRIEF DESCRIPTION OF THE DRAWINGS

These and other features and advantages of the invention will be better apparent from the following description of some exemplary and non-limitative embodiments, to be read with reference to the attached drawings, wherein.

DETAILED DESCRIPTION OF EXAMPLE EMBODIMENTS

Figure 2:
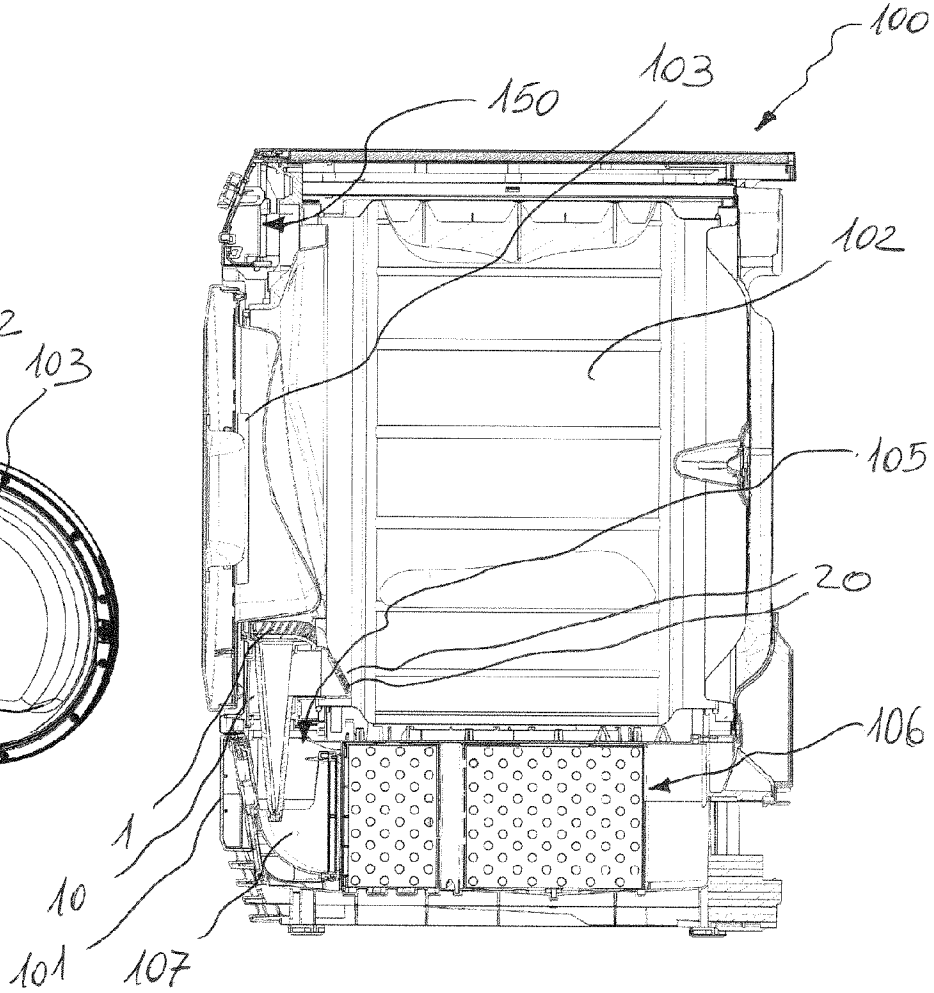
FIG. 2 is a side sectional view of the tumble dryer of FIG. 1 with the door assembly in a closed configuration.
Figure 1:
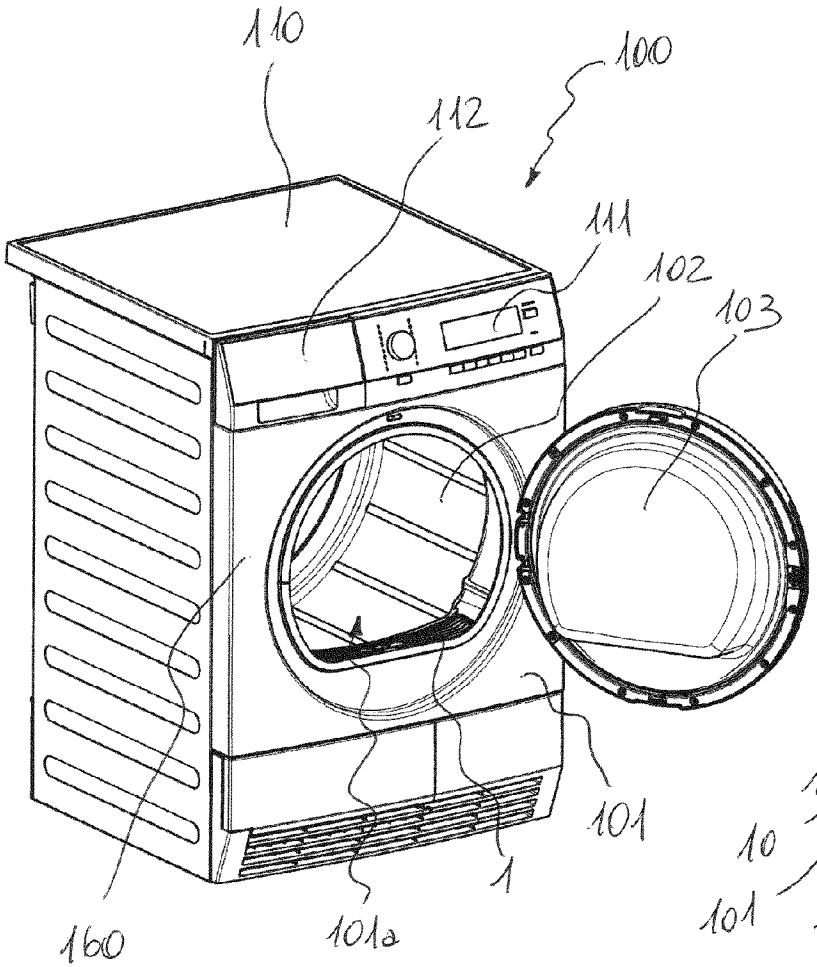
FIG. 1 is a perspective view of a tumble dryer according to the present invention, with a door assembly in an open configuration.

With reference initially to FIGS. 1 and 2, a tumble dryer realized according to aspects of the present invention is globally indicated with the reference number 100.

It should be in any case underlined that the present invention is not limited to tumble dryers but it can be also usefully applied to all laundry treating machines comprising a drying phase for clothes, as for example a combined washing and drying machine.

As shown in FIG. 1, the tumble dryer 100 comprises an outer casing 110, preferably but not necessarily parallelepiped-shaped, and a treatment chamber, such as a drum 102, for example having the shape of a hollow cylinder, for housing the laundry and in general the clothes and garments to be dried. The drum 102 is preferably rotatably positioned in the casing, so that it can rotate around an axis thereof. According to the present embodiment, the rotation axis of the drum 102 is substantially horizontal but it should be appreciated that, as an alternative, the drum can be positioned in the casing 110 in such position that its rotation axis is tilted.

A mouth or aperture 101*a* is defined in the casing, facing the treatment chamber and thus granting access to the drum for loading and unloading the laundry in the device. The laundry treatment device 100 further comprises a door assembly 103, preferably pivotally associated to the casing 110 and displaceable between an open position, in which access to the drum is granted, and a closed position, shown in FIG. 2, in which the aperture 101*a* is closed or preferably sealed.

According to the present embodiment, the aperture 101*a* is defined in a front face 160 of the casing 110, in which are also located a control panel 111 of the device 100 and a drawer 112 suitable for collecting water condensed during drying cycles.

With reference now to FIG. 2, the tumble dryer 100 comprises an air circulating system 106 adapted to circulate a flow of drying air into the drum 102. Circulation of the drying air evaporates the moisture from the wetted laundry in the drum 102 thus forming a flow of moisture-laden air, hereinafter indicated as flow exhausted air.

Figure 3B:
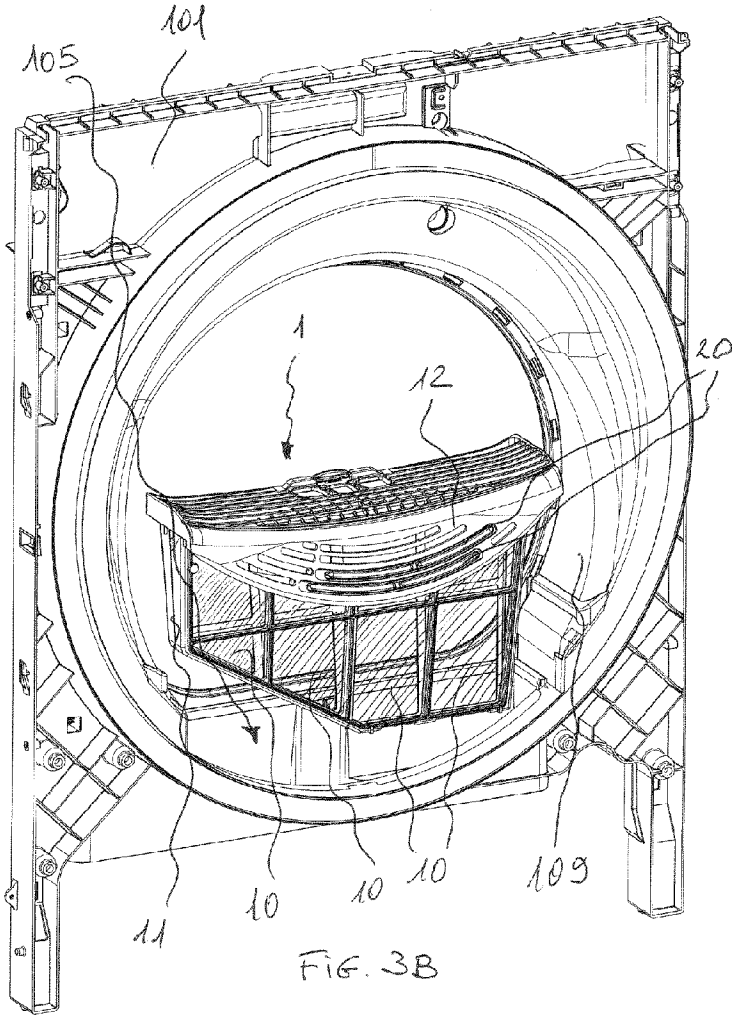
FIGS. 3A and 3B are rear perspective views of a front bulkhead of the tumble dryer of the present invention with a lint filter assembly inserted and removed in a housing, respectively.
Figure 3A:
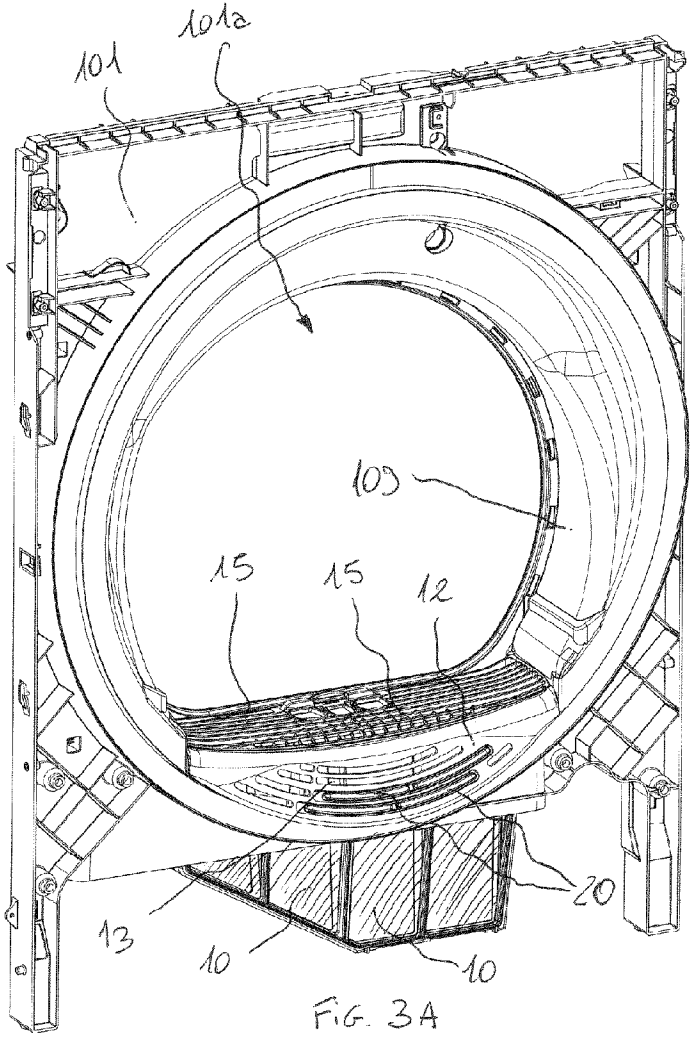

The air circulation system 106 advantageously comprises an exhaust air outlet circuit 107 which communicates with the drum 102 through an outlet defined by a housing 105 in which a lint filter assembly 1, which will be described in detail in the following, can be removably housed. As it can appreciated from FIGS. 3A and 3B the housing 105 is advantageously defined in a front bulkhead 101 of the casing 110 (advantageously positioned below the front face 160, or preferably coinciding with the front face 160), preferably in correspondence of a peripheral surface 109 of the mouth 101*a*.

Advantageously, the housing 105 is provided in the lower part of the mouth 101*a*,and the lint filter assembly 1 is preferably inserted in the housing 105 by lowering it from the mouth 101*a*.

In this manner the lint filter assembly 1 can be easily reached by the hand of a person and, at the same time, advantageously no fastening elements are required in order to maintain the filter assembly 1 in the housing 105. According to a preferred embodiment, the filter assembly can be removed and positioned/placed back in the housing 105 simply by pulling it without disengaging/engaging any fastener or other coupling members, such as a snap-fit coupling.

It will be appreciated that the filter assembly 1 is shaped such that when it is correctly positioned in the housing 105, it totally or substantially totally intercepts the flow of exhausted air from the laundry drum. Advantageously, the filter assembly 1 comprises perforations 13, 15 allowing the passage of the flow of exhausted air towards the exhaust air outlet circuit 107 passing through a filtering surface 10, comprising preferably a fine mesh net.

The lint filter assembly 1 further comprises a pair of electrodes 20 positioned on the filter assembly such that the laundry in the drum 102 can come into contact with these electrodes 20 when the filter assembly is correctly positioned in its housing 105. In other words, the electrodes 20 preferably face the interior of the drum 102 and are connected/connectable to an electric circuit for transmitting a signal obtained from the electrodes 20, advantageously when they come into contact with wet clothes, to a control unit (150) of the dryer adapted to control the operations of the drier. The control unit (150) is advantageously configured for detecting the signal from the electrodes and processing it in order to obtain information about the actual humidity of the laundry and controlling accordingly the duration of the drying cycle and/or other operation parameters.

With reference now to FIGS. 4A, 4B, 5 and 5A, the lint filter assembly 1 will be described in detail.

Figures 5, 5A, 6:
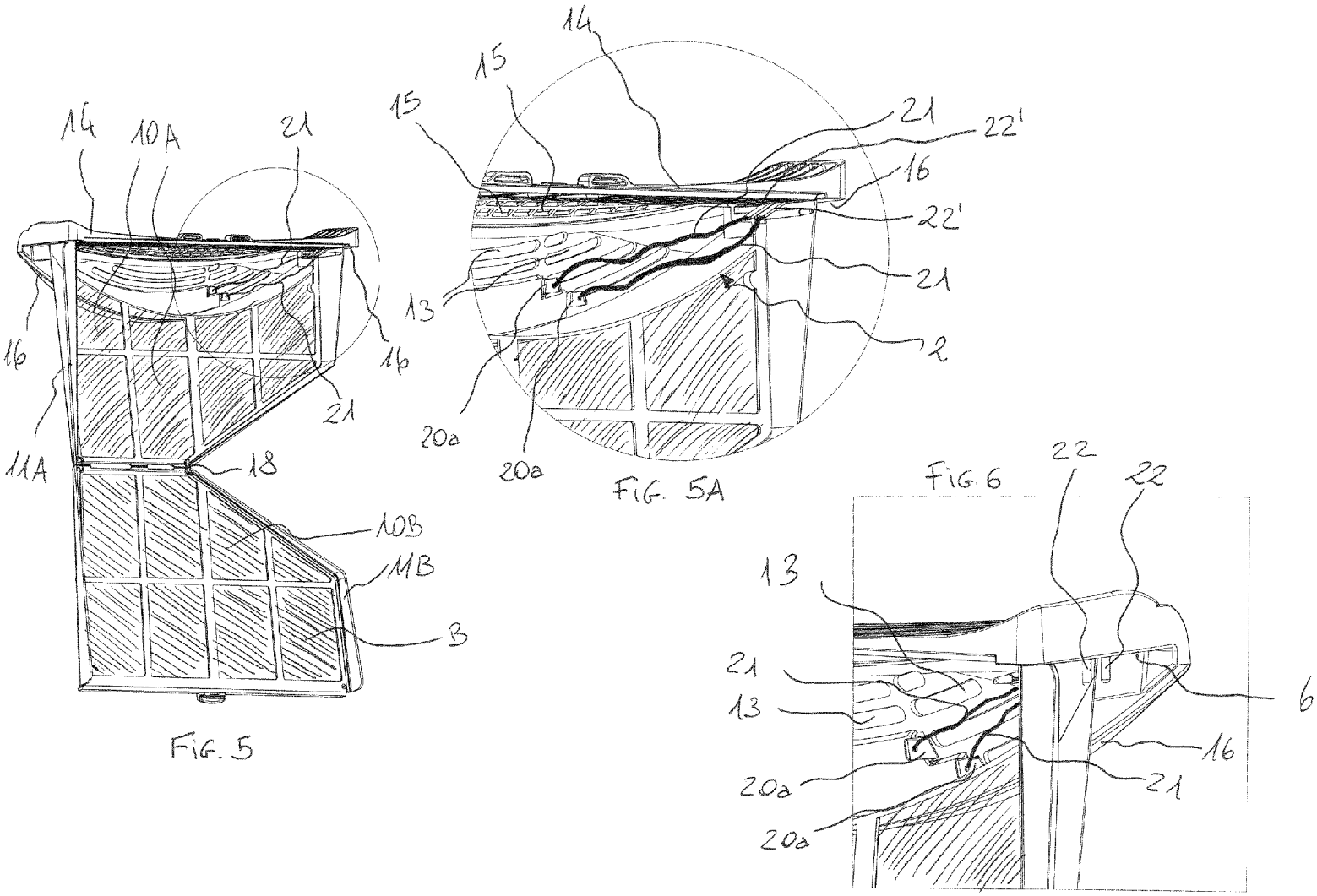
FIGS. 5 and 5A are a perspective view and a respective enlarged detail of the lint filter assembly of FIG. 4 in an open configuration.
FIG. 6 is a perspective view of the lint filter assembly showing plugs of an electrical connector.

According to the present embodiment, the filter assembly 1 is preferably wedge-shaped and comprises a frame 11 supporting at least one filtering surface 10. As shown in FIG. 5, the filter assembly 1 is advantageously made so as it can be opened and, to this purpose, the frame 11 preferably comprises two halves 11A and 11B hinged by a resilient connection 18 or by other hinge members.

According to a preferred embodiment, each half of the frame supports a plurality of respective filtering surfaces 10, between which a volume is defined when the filter assembly is closed.

Advantageously, the flow of exhausted air passing through perforations 13, 15 is directed towards said volume and, accordingly, fluff and other small particles dragged by the flow of exhausted air remain trapped inside the volume. To this purpose, the filtering surfaces 10 are preferably formed by a very fine mesh that allows the passage of the flow of air while avoiding the passage of fluff and other similar particles.

As previously explained, the housing 105 is dimensioned such that the frame 11 with the filtering surfaces 10 can be housed therein, intercepting the flow of exhausted air that can enter the exhausted air outlet circuit only by passing through perforations 13, 15 and, consequently, through the filtering surfaces.

It will be appreciated that the lint filter assembly could be realized also according to different embodiments, provided that, when correctly positioned in its housing, it is capable of intercepting the flow of exhausted air directed towards the outlet circuit and of retaining fluff and similar materials by means of suitable filtering elements.

With reference again to FIG. 4B, electrodes 20 are advantageously mounted on a supporting surface 12 of the filter assembly 1, onto which the perforations 13 are defined.

Preferably, electrodes 20 are oblong shaped and can be removably housed in respective seats 17 provided in the supporting surface 12. Electrodes could be mounted in the seats by means of snap-fit connection or by means of any other suitable fastener.

Advantageously, filter assembly 1 further comprises a further perforated surface 14, in which perforations 15 are defined, which merges with the peripheral surface 109 of the mouth 101*a* when the filter assembly is placed in the housing.

Preferably, the supporting surface 12 is tilted to the perforated surface 14, so as to face the interior of the drum according to a direction which promotes the contact of the laundry with the electrodes.

Is should be appreciated that, as previously illustrated, electrodes 20 are advantageously integral with the filter assembly and, accordingly, they can be easily removed for cleaning or maintenance purposes together with the filter assembly. Furthermore, since the electrodes are advantageously mounted on the filter assembly, no dedicated support is required.

In order to transmit the signal obtained from the electrodes 20 when the laundry comes into contact therewith, the electric circuit comprises at least one electrical connector arranged in such a way to electrically connect the electrodes 20 to the control unit 150 when the filter assembly 1 is correctly positioned in its housing 105 and not to connect the electrodes 20 to the control unit 150 when the filter assembly 1 is not positioned or not correctly positioned in its housing 105.

Figures 4A, 4B:
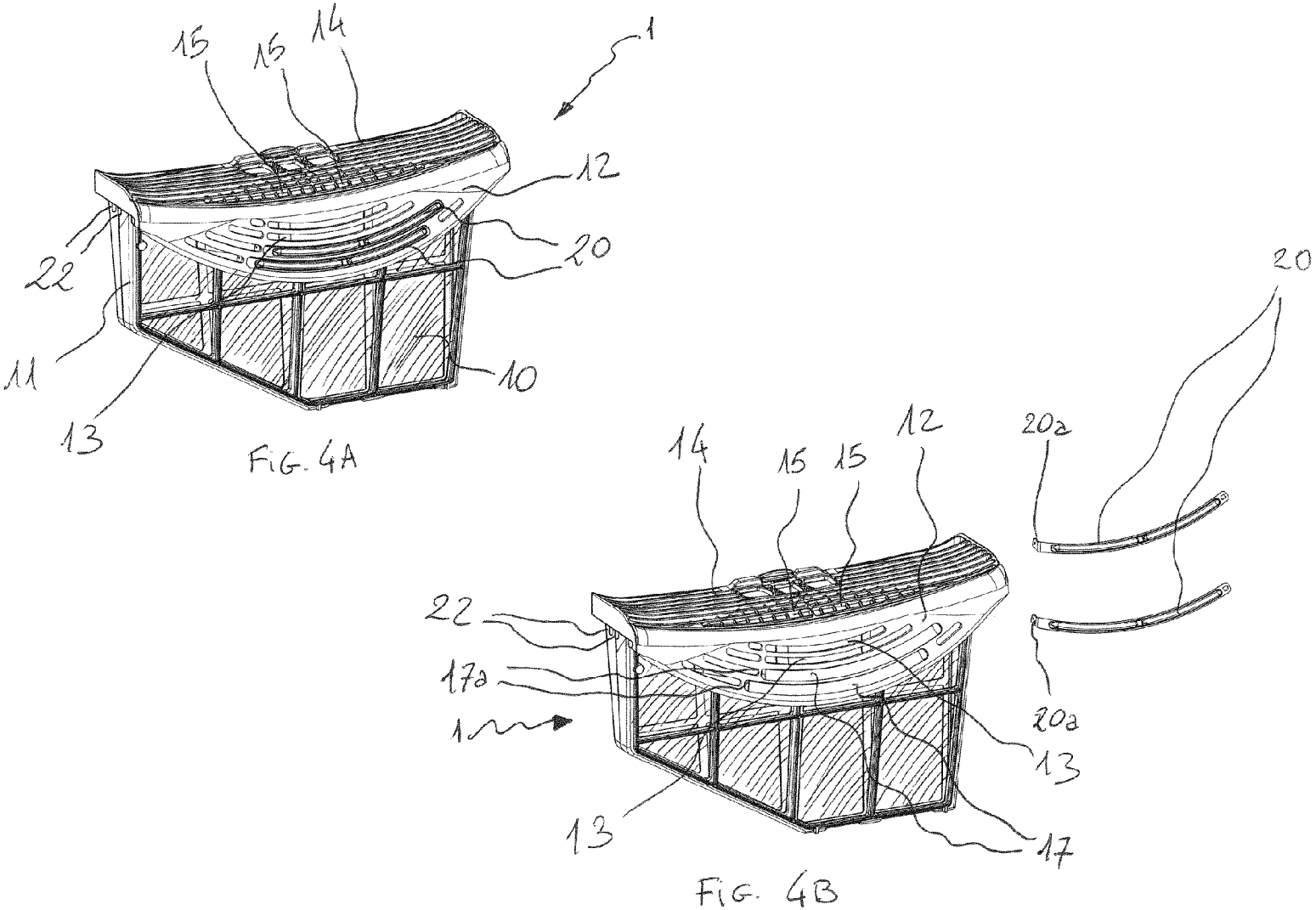
FIGS. 4A and 4B are perspective views of the lint filter assembly of FIG. 3A with electrodes respectively mounted on/removed from a supporting surface.

According to a preferred embodiment, electrodes 20 comprise a connecting end 20*a* projecting towards the interior of the lint filter assembly 1 and connected to a wire 21, as shown in FIGS. 4B and 5A. To this purpose, seats 17 are provided, having an opening 17*a* through which the connecting end 20*a* passes.

Preferably, wires 21 connect each one of the electrodes 20 to a respective connecting plate 22' of a plug 22, preferably defining a male element of the electrical connector. Advantageously, the filter assembly 1 comprises a pair of plugs 22, each connected to a respective electrode 20.

It will be also appreciated that in the present embodiment, in which the lint filter is preferably wedge-shaped and, accordingly, it has a substantially rectangular cross section, the plugs 22 are advantageously positioned on the same short side of the rectangle.

Always according to a preferred embodiment, plugs 22 project downward from a border 16 of the filter assembly 1. It will be also appreciated that the border 16 is advantageously at least partially resting on an edge 108 of said housing 105, thus allowing a proper position of the lint filter assembly 1 in the housing 105. To this regard, it should be noted that within the context of the present invention the lint filter assembly will be considered properly or correctly positioned as long as the flow of exhausted air passes almost entirely through the filtering surfaces 10. In other words, although a perfect seal is preferably not required according to the present invention, the passage of air between the edge 108 and the border 16 should be sufficiently reduced in order to almost completely avoid the passage of fluff and similar materials towards the outlet circuit 107.

Figure 7A:
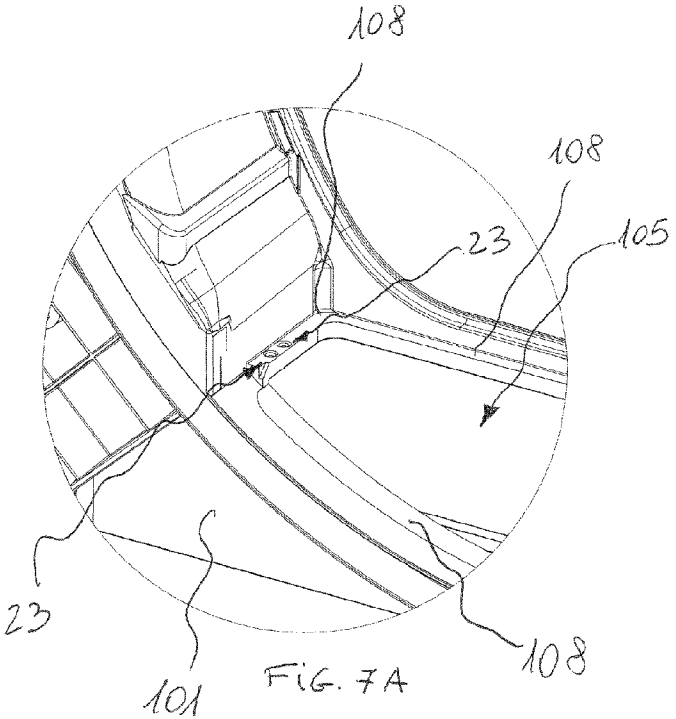
FIGS. 7 and 7A are a rear perspective view and a respective detail of the front bulkhead showing sockets of the electrical connector of FIG. 6.
Figure 7:
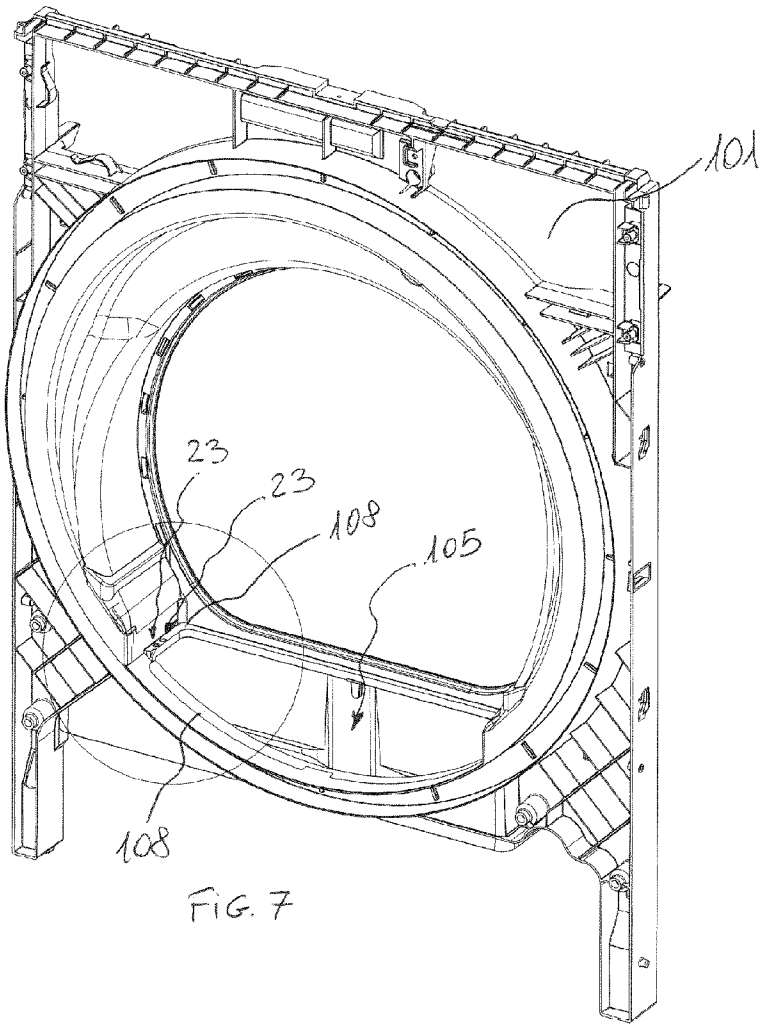

With reference now to FIGS. 7 and 7A, the front bulkhead 101 preferably comprises sockets 23 for receiving the plugs 22 and accordingly electrically connecting electrodes 20 to the control unit 150. Sockets 23 are connected to the control unit in a conventional manner and, therefore, when the electric contact between plugs 22 and sockets 23 is closed, the signal obtained from the electrodes can be transmitted to the control unit 150.

Figure 10:
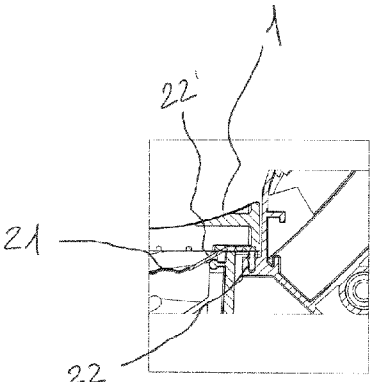
FIG. 10 is a sectional view along line X-X of FIG. 9, of the electrical connectors of FIG. 9.
Figure 9:
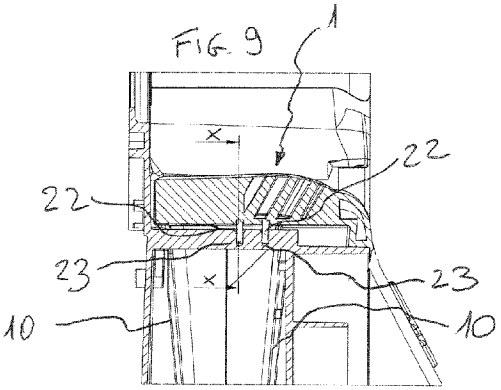
FIG. 9 is a sectional view along line IX-IX of FIG. 8, showing the electrical connectors in a closed connecting the electrodes to the control unit.
Figure 8:
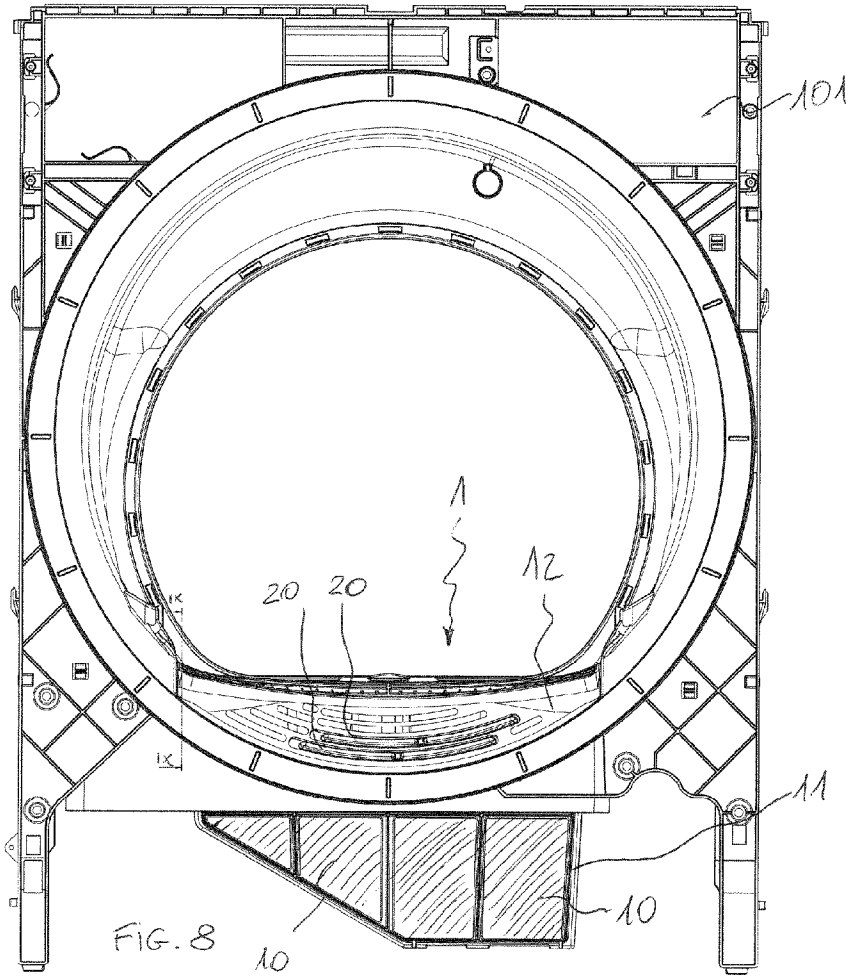
FIG. 8 is a rear view of the front bulkhead of the tumble dryer of the present invention with a lint filter assembly inserted in the respective housing.

Preferably, sockets 23 are formed on the edge 108 so that a correct positioning of the lint filter assembly 1 in the housing 105 is required in order to close the contact. This advantageously allows detecting the correct positioning of the filter assembly or its absence or incorrect positioning, by means of the electrical connectors 22, 23. In fact, as shown in FIGS. 8 to 10, the shape coupling between plugs 22 and sockets 23, their position on the filter assembly and on the bulkhead, respectively, and the downwards arrangement of the housing 105, guarantee that as long as the electric contact made by the electrical connectors is closed, the filter assembly is properly (i.e. correctly) positioned.

Although according to the present embodiment the electrical connector comprises a plug and a socket on the filter assembly and on the bulkhead, respectively, it will be appreciated that also different solution can be envisaged. By way of example the plug can be provided on the bulkhead and the socket on the filter assembly, or even different type of electrical connectors could be used, such as a couple of conductive plates entering into contact each other when the filter assembly is properly positioned.

According to a preferred embodiment, the control unit can advantageously emit a warning signal (e.g. a sound and/or a light) and/or inhibit operation of the dryer 100 when said contact is open, i.e. when the filter assembly is absent or incorrectly placed in the housing 105. In this manner, it is possible to avoid the risk of operating the dryer without properly filtering the fluff from the flow of exhausted air.

A second embodiment of the present invention is shown in FIGS. 11 to 14B and will be described in the following only with reference to the differences with the previously described embodiment.

Figure 12:
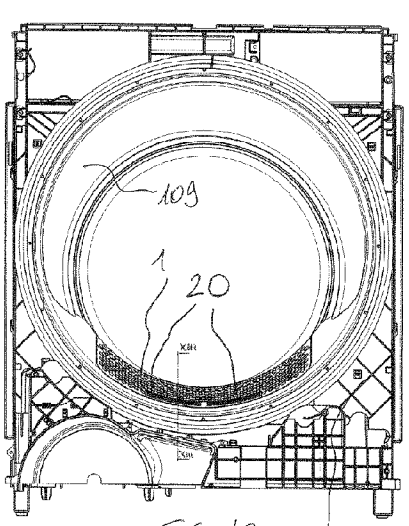
FIG. 12 is a rear view of the front bulkhead, laundry drum and air circulating system of FIG. 11.
Figure 13:
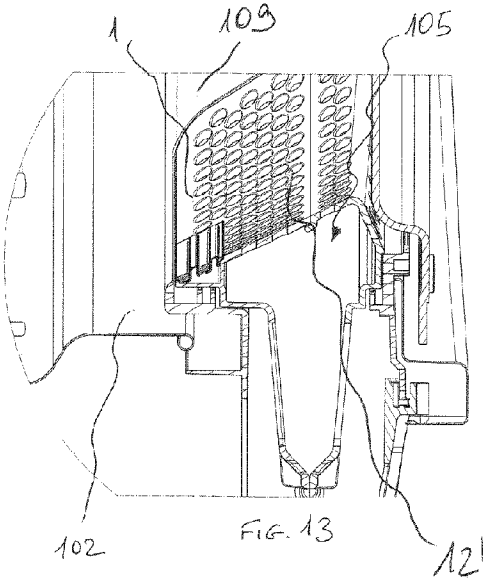
FIG. 13 is a side sectional view along line XIII-XIII of FIG. 12 of the lint filter assembly according to the embodiment of tumble dryer of FIG. 11 inserted in the respective housing.
Figure 11:
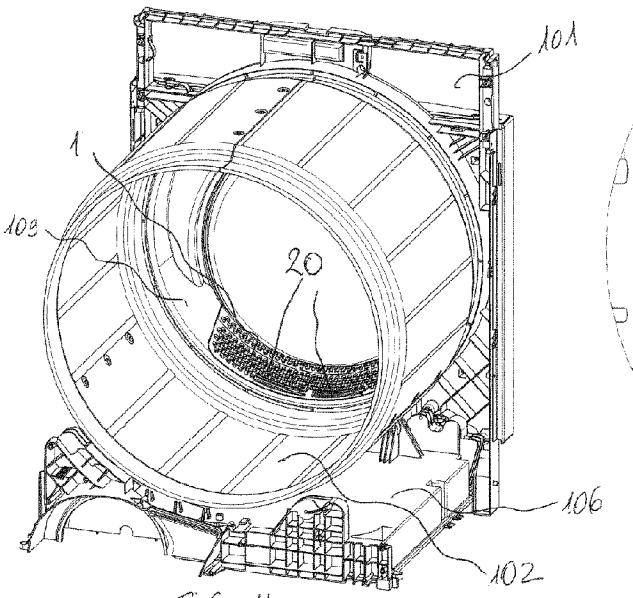
FIG. 11 is a rear perspective view, with some parts removed for clarity, of a second embodiment of a tumble dryer according to the present invention showing a front bulkhead, a laundry drum and an air circulating system with a lint filter assembly inserted the respective housing.

As shown in FIGS. 11 and 12, in the second embodiment of the present invention the filter assembly 1 comprises a supporting surface 12' developing as curved surface, slanting from the mouth 101*a* of the front bulkhead towards the drum 102 in order to obtain a smooth transition from the mouth 101*a* to the laundry drum 102. Preferably, the supporting surface 12' is also flush with the peripheral surface 109.

Figure 14B:
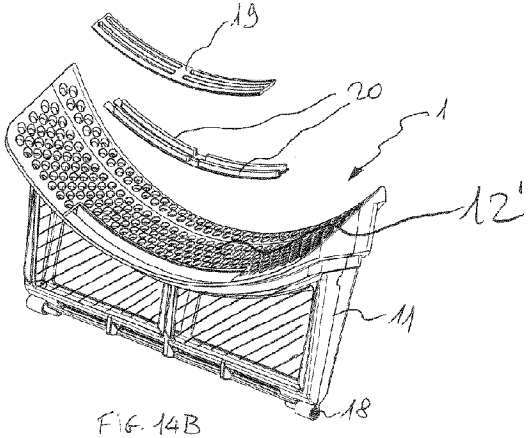
FIGS. 14A and 14B are perspective views of the lint filter assembly of FIG. 11 with electrodes respectively mounted on/removed from the supporting surface.
Figure 14A:
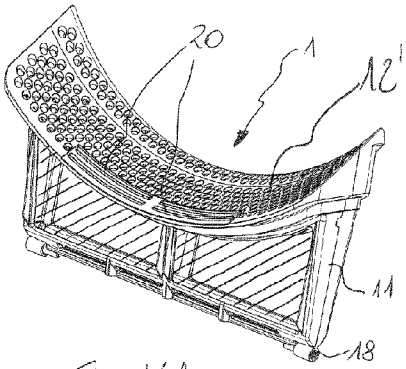

With reference to FIGS. 14A and 14B, the filter assembly of the second embodiment of the invention further comprises a cover 19 to be placed above the electrodes 20 in order to have a more steady connection of the electrodes to the supporting surface 12' and to better protect them against the contact with rigid parts of the clothes, such as buttons or zippers.

It has thus been shown that the present invention allows all the set objects to be achieved. In particular, it makes possible to eliminate any dedicated support for the electrodes and to simplify the geometry of the air duct. Furthermore, in the tumble dryer according to the invention it is advantageously possible to use the filter as a support and use the connections of the sensors to verify the correct positioning and/or the absence of the filter itself. As a consequence, the dryer can be used with the filter always properly placed, reducing the risks of clogging of critical, inaccessible areas and/or of electrical components and providing, in general, a better functionality of the dryer.

The invention claimed is:

1. A tumble dryer comprising:

a laundry drum rotatably supported in a casing and suitable to receive laundry to be dried;

a lint filter assembly which can be housed in a housing provided in said casing so that, when the lint filter assembly is placed in said housing, it intercepts a flow of air exiting said laundry drum;

a humidity sensor system for retrieving information about the actual humidity of the laundry in the drum, said humidity sensor system comprising at least a pair of electrodes positioned such that the laundry in said drum can come into contact with said electrodes;

a control unit for controlling the operations of the tumble drier;

an electric circuit for transmitting a signal obtained from said electrodes to the control unit;

wherein said electric circuit comprises at least one electrical connector arranged in such a way to electrically connect said electrodes to said control unit when said filter assembly is correctly positioned in said housing and not to connect said electrodes to said control unit when said filter assembly is not positioned or not correctly positioned in said housing.

2. The tumble dryer according to claim 1, wherein said casing comprises a front bulkhead in which a mouth through which the laundry can be loaded/unloaded in/from said laundry drum is defined, said mouth comprising a peripheral surface in which said housing is defined.

3. The tumble dryer according to claim 2, wherein said lint filter assembly comprises a frame supporting at least one filtering surface, said electrodes being positioned on a supporting surface of said frame facing the internal of said laundry drum when the filter assembly is housed in said housing.

4. The tumble dryer according to claim 3, wherein said supporting surface is placed above a mouth of said housing defining an outlet for the flow of exhausted air.

5. The tumble dryer according to claim 3, wherein said supporting surface comprises perforations allowing the passage of the flow of exhausted air towards said at least one filtering surface.

6. The tumble dryer according to claim 5, wherein said filter assembly comprises a further perforated surface, said supporting surface being tilted to said perforated surface.

7. The tumble dryer according to claim 3, wherein said supporting surface develops as curved surface, slanting from said mouth of said front bulkhead towards said drum.

8. The tumble dryer according to claim 2, wherein said electrical connector comprises at least a plug and socket connection.

9. The tumble dryer according to claim 8, wherein said plug and said socket are provided on said lint filter assembly and on said bulkhead next to said housing, respectively, or vice-versa.

10. The tumble dryer according to claim 8, wherein said filter assembly comprises a border which is at least partially resting on an edge of said housing.

11. The tumble dryer according to claim 10, wherein said plug projects from said border.

12. The tumble dryer according to claim 3, wherein said electrodes are removably housed in a respective seat on said supporting surface.

13. The tumble dryer according to claim 1, wherein said lint filter assembly is wedge-shaped and has a substantially rectangular cross section, said contact being positioned at the same short side of said rectangle.

14. The tumble dryer according to claim 1, wherein said control unit is configured in such a way to emit a warning signal and/or inhibit operation of the dryer when said electrodes are not connected to said control unit.

15. The tumble dryer according to claim 1, comprising a first and a second electrical connectors each connected to a respective electrode.

16. The tumble dryer according to claim 1, wherein said lint filter assembly comprises a frame supporting at least one filtering surface, said electrodes being positioned on a supporting surface of said frame facing the internal of said laundry drum when the filter assembly is housed in said housing.

17. The tumble dryer according to claim 1, wherein said electrical connector comprises at least a plug and socket connection.

18. The tumble dryer according to claim 1, wherein said filter assembly comprises a border which is at least partially resting on an edge of said housing.

* * * * *